United States Patent [19]

Kestel, Jr.

[11] Patent Number: 4,663,908

[45] Date of Patent: May 12, 1987

[54] THERMAL EFFICIENT BUILDING

[76] Inventor: John F. Kestel, Jr., Rte. #2, Box 299, Mt. Gilead Rd., Sadieville, Ky. 40370

[21] Appl. No.: 869,300

[22] Filed: Jun. 2, 1986

Related U.S. Application Data

[63] Continuation of Ser. No. 530,274, Sep. 8, 1983, abandoned, which is a continuation-in-part of Ser. No. 222,067, Jan. 2, 1981, abandoned.

[51] Int. Cl.[4] ..... E02D 27/00; F04C 5/00

[52] U.S. Cl. ..... 52/293; 52/90; 52/274; 52/714

[58] Field of Search ..... 52/274, 293, 294, 714, 52/246, 265, 268, 90, 712, 713

[56] References Cited

U.S. PATENT DOCUMENTS

| | | | |
|---|---|---|---|
| 2,034,766 | 3/1936 | Navarre | 52/274 X |
| 2,078,069 | 4/1937 | Eliel | 52/293 |
| 2,139,461 | 12/1938 | Pride | 52/274 |
| 2,390,929 | 12/1945 | Ellis | 52/714 X |
| 2,653,469 | 9/1953 | Callan | 52/274 |
| 3,471,988 | 10/1969 | Allen | 52/293 X |
| 4,041,722 | 8/1977 | Terlesky et al. | 52/294 X |

FOREIGN PATENT DOCUMENTS

| | | | |
|---|---|---|---|
| 526056 | 2/1954 | Belgium | 52/714 |
| 235529 | 4/1945 | Switzerland | 52/714 |

*Primary Examiner*—Carl D. Friedman
*Assistant Examiner*—R. Chilcot
*Attorney, Agent, or Firm*—Cushman, Darby & Cushman

[57] ABSTRACT

A thermal efficient building generally comprising first and second parallel vertical walls opposingly disposed defining a cavity therebetween and constructed upon a rigid base foundation wherein the foundation is constructed so that the depth of the wall cavity into which an insulation material is inserted is selected according to geographical location, meteorological and climatical conditions and which provides increased thermal protections against ambient thermal conditions. The building may also comprise a horizontal ceiling and roof defining a cavity therebetween which connects with the cavity defined between the first and second vertical walls, and a horizontal roof and subfloor defining a cavity therebetween which connects with the cavity defined between the first and second vertical walls. All three cavities are filled with insulating material to create a thermally-insulating envelope. The first vertical wall may be a mansonry wall, in which case a mortar anchor is utilized comprising a rod with a first, deviously bent end and a second end bent at a substantial right angle and terminating in a point, the anchor extending across the cavity between the first and second vertical walls to provide support for the masonry wall.

23 Claims, 5 Drawing Figures

THERMAL EFFICIENT BUILDING

This is a continuation of application Ser. No. 530,274, filed Sept. 8, 1983, which was abandoned upon the filing hereof and which was a continuation-in-part of my abandoned application Ser. No. 222,067, filed Jan. 2, 1981 now abandoned.

BACKGROUND AND SUMMARY OF THE INVENTION

This invention generally relates to a type of building construction which provides high thermal efficiencies and minimizes heat losses attributable to the winter months and heat gains attributable to the summer months. More specifically, the present invention relates to a building structure which is thermally efficient and which can be constructed to achieve maximum thermal efficiency depending upon the geographical location in which the building is constructed.

In recent years, the supplies of conventional fuels used for heating and cooling building structures have declined. Most notably, the conventional supplies of energy sources of fossil fuels in the form of heating oil or natural gas have not been able to achieve parity with the demand for their consumption. The decline in supply of conventional fossil fuels coupled with a relatively constant or increased demand for their consumption has dramatically increased the cost of obtaining these conventional fuels. The increased cost is passed on to individual consumers and is reflected in increased utility bills for heating or cooling a private home, business structure or the like. Thus, it has become imperative to decrease the consumption of such fuels in order to reduce the cost of heating and cooling a building structure.

A primary method of reducing consumption of such fossil fuels in the short term is a conservation effort. In this regard, it has been suggested by government authorities, engineers, and contractors that buildings be constructed in a more thermally efficient manner. Thermal efficiency can be achieved in a building by providing a thermal barrier type insulation in the wall construction, below the finished floor and above the ceilings in an attic space or the like such that a thermally protected building envelope is effected.

The advantages which inure to such construction techniques primarily result in less heat loss or gain, depending upon the ambient weather conditions, resulting in less fuel consumption needed to operate the heating and cooling equipment of a building structure. Since less fuel is consumed in heating and cooling a building utilizing the insulating envelope method of construction, the owner of an insulated building enjoys the advantage of lower overall fuel costs. The public is additionally benefitted by such construction since less fuel used on a large basis means that overall national fuel consumption will be reduced, thereby gaining relief from short fuel supplies.

In the past, buildings which have utilized the envelope-type insulating method of construction have been somewhat successful in decreasing the overall fuel consumption utilized in a building for heating and cooling purposes. However, conventional construction techniques have not changed dramatically since the advent of the short fuel supplies of recent years.

Conventional building techniques basically utilize a foundation upon which vertical stud members generally spaced 16" apart are constructed. On the exterior face of the stud members, plywood or other material is provided to enclose the exterior portion of the building. On the exterior portion of such plywood or like material, there is usually provided a finishing material such as masonry brick, shingles, aluminum siding or the like.

The construction of the stud members 16" apart provides a space into which insulation can be placed or inserted prior to finishing the interior walls by nailing or affixing dry wall, sheet rock, panel board, or the like to the stud members. Thus, according to conventional construction techniques, if, for example, nominal 2"×4" stud members are utilized, the maximum depth of insulation would generally be only 4". Since no insulation is provided between the vertical stud members and the finished exterior wall, there is a convenient path of least resistance for thermal conductivity.

According to the present invention, however, there is provided a construction technique which allows the contractor to provide a total insulating barrier between the interior walls of a building and the exterior walls. More specifically, the present invention provides for an increased foundation such that the geographical location of the building is taken into account. The increased top horizontal surface of the foundation provides for the construction of the interior and exterior walls to be horizontally spaced thereby forming a cavity. There can be inserted or placed into the cavity insulating material, such as, for example, blown insulation, fiberglass or the like.

Additionally, according to the present invention, there is provided in the horizontal top surface of the foundation a continuous slot which a portion of the insulation inserted into the wall cavity can occupy. The continuous slot creates a thermal occlusive seal between the exterior and interior walls where they are joined to the top horizontal surface of the base foundation.

According to another embodiment of the present invention, there is provided a pre-formed concrete block foundation upon which a thermal efficient building can be constructed. The preformed concrete blocks utilized by the present invention are those which are generally rectangular in shape and which necessarily have one horizontal dimension larger than the associated second perpendicular horizontal dimension. In this manner, the contractor can choose which dimension will determine the thickness of the foundation, thereby defining the depth of the wall cavity.

According to another embodiment of the present invention, the exterior wall is constructed of masonry brick and mortar. Conventional mortar anchors are designed to span only approximately four inches of space between the inner wall and the outer masonry wall. Conventional mortar anchors thus cannot be used in a building constructed in accordance with the present invention if the depth of the wall cavity is greater than 4 inches. In accordance with the present invention, a mortar anchor comprising a rod preferably having a sinusoidally-shaped first end and a pointed, right-angled second end is used to support the masonry wall. The distance between the two ends of the mortar anchor are determined by the depth of the wall cavity.

Therefore, according to the present invention there is provided a thermal efficient building which can be constructed taking into account the meteorological and climatical conditions associated with a particular geographical location. In this manner, the attendant heat losses during the cold winter months and the heat gains during the warm summer months are minimized. The minimal thermal fluctuation necessarily contributes to decreased energy and fuel usage to maintain the interior of the building at a comfortable or desired temperature. Therefore, according to the present invention, energy and fuel can be saved with the associated benefit of lowering the overall fuel costs.

DETAILED DESCRIPTION OF THE DRAWINGS

Figure 1:
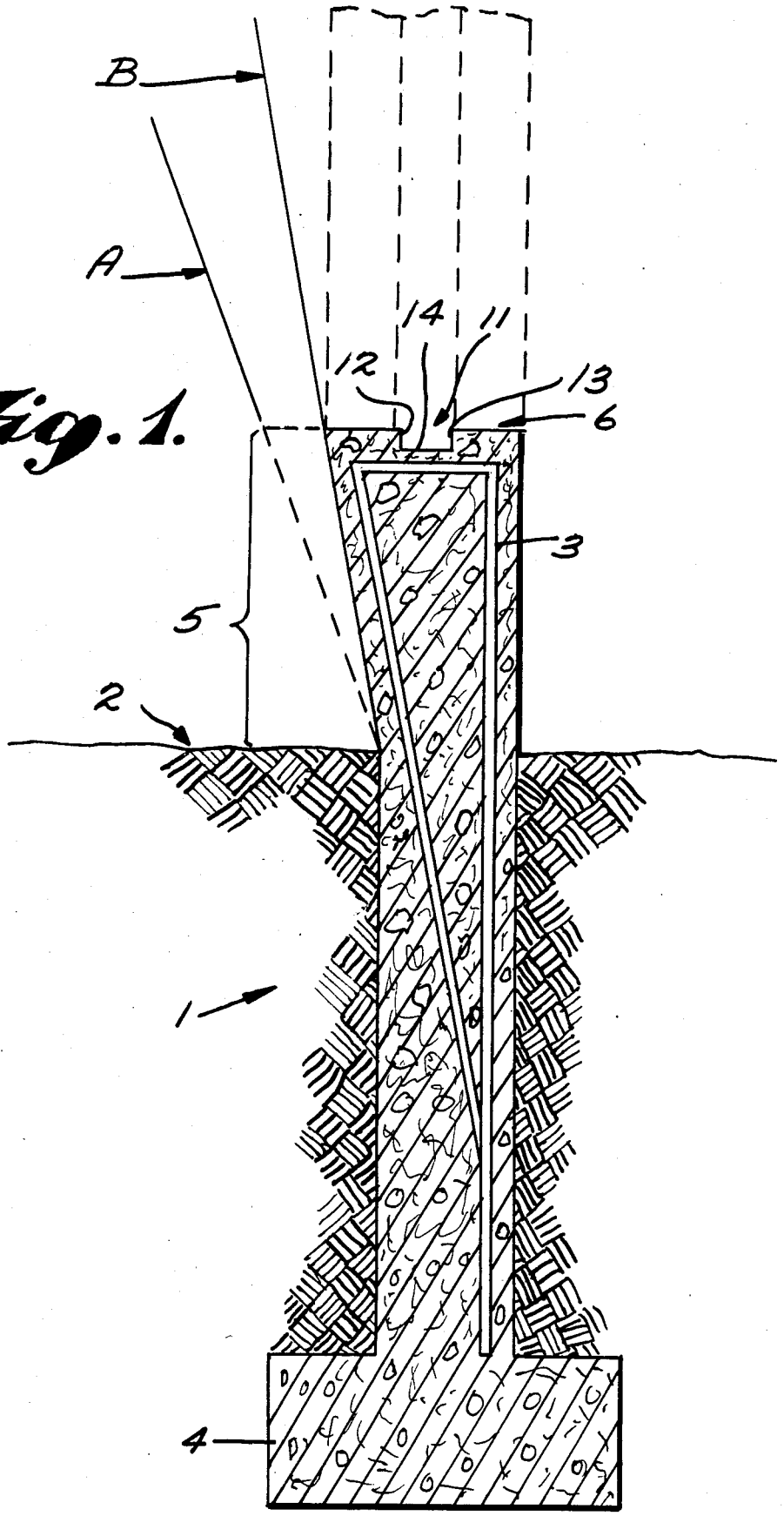
FIG. 1 is a cross-sectional view of an embodiment of a base foundation utilized in the present invention.
Figure 2:
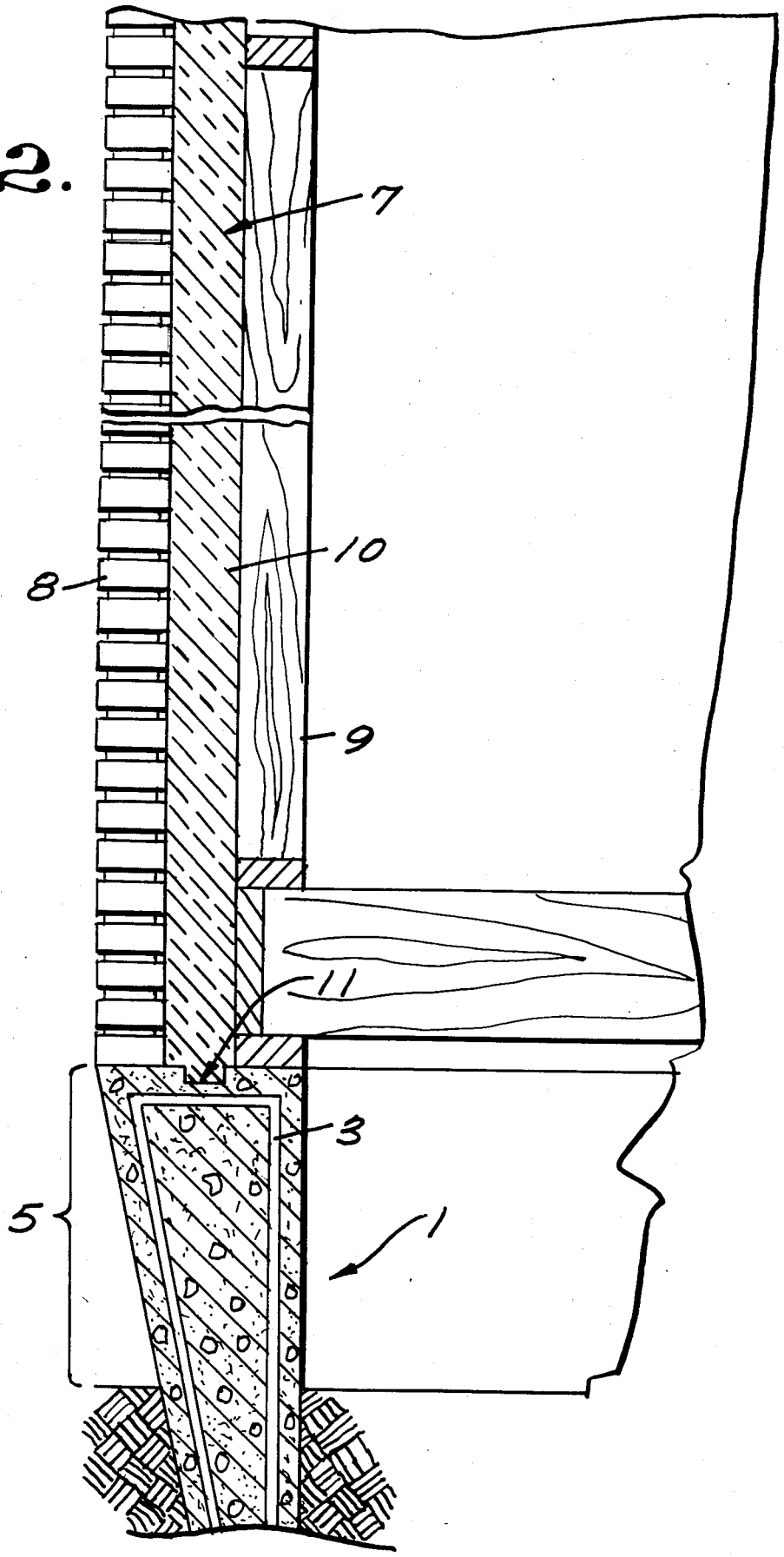
FIG. 2 is a cross-sectional view of a portion of a thermal efficient building showing the base foundation embodiment of FIG. 1 with the walls and floor of the building constructed thereon.

Referring now more specifically to FIGS. 1 and 2, it can be seen that an embodiment of the base foundation 1 of the present invention generally comprises a vertical structure, a portion of which is below finished grade 2. The structure is constructed from rigid materials, such as, for example, poured concrete with the necessary reinforcement steel bars 3. The poured base foundation 1 can additionally have a poured footing 4 which is intended to distribute the load of the thermal efficient building and provide a more secure and rigid foundation.

The contractor which constructs the thermal efficient building can select the amount of inclination that the upper portion 5 of the exterior surface of the base foundation 1 will have, thereby increasing the cross-sectional dimension of the horizontal top surface 6 of the base foundation 1. The contractor's decision will, of course, be based upon the geographical location in which the thermal efficient building is to be constructed. If, for example, the thermal efficient building is to be constructed in an extremely cold climate, the contractor may choose to incline the upper portion 5 of the exterior surface of the base foundation 1 as depicted in FIG. 1 as a position A. By constructing the base foundation 1 in a manner which corresponds to position A, the contractor can thereby increase the cross-sectional dimension of the horizontal top surface 6 of the base foundation 1, and thereby increase the depth of the associated wall cavity 7 shown in FIG. 2. If, for example, the thermal efficient building is to be constructed in a generally warm climate, the contractor may choose to incline the upper portion 5 of the exterior surface of the base foundation 1 corresponding in FIG. 1 to position B. By constructing the thermal efficient building with a base foundation 1 whose upper portion 5 of the exterior surface corresponds to position B, the cross-sectional dimension of the horizontal top surface 6 will necessarily be decreased compared to the same dimension corresponding to position A, thereby decreasing the depth of the associated wall cavity 7 of FIG. 2.

As shown in FIG. 2 selection of the amount of inclination on the upper portion 5 of the exterior surface of the base foundation 1 necessarily determines the depth of the wall cavity 7 defined between the exterior wall 8 and the interior wall 9. Interior wall 9 may preferable be constructed from 2"×4" vertical stud members spaced generally 16" apart. Thus, insulating material 10 can be provided in the space between each vertical stud member as additional thermal protection.

The wall cavity 7 is intended to be filled with an insulating material 10 such as, for example, blown insulation, fiberglass insulation or the like. The insulating properties of these materials necessarily increases as the depth of the material increases. Therefore, it should understood by one skilled in the art that the colder the climate in which the thermal efficient building is constructed, the deeper the wall cavity 7 needs to be so that a sufficient thickness of insulating material 10 can be provided to adequately protect the building from the ambient thermal conditions. It should also be understood by one skilled in the art that position A and position B are not determinative of the maximum or minimum inclinations of the upper portion 5 of the exterior surface of the base foundation 1. The exact dimensional requirement of the horizontal top surface 6 of the base foundation 1 will necessarily be determined by the contractor, engineer or architect prior to constructing the base foundation 1 considering the factors of geographical location and normal meteorological and climatical conditions associated therewith.

An important feature of the present invention relates to the occlusive sealing by the insulating material 10 contained in the wall cavity 7 with the base foundation 1. For this purpose as shown in FIG. 1, there is provided in the top horizontal surface 6 of the base foundation 1 a continuous slot 11 located approximately midway in the horizontal top surface 6 of the base foundation 1 corresponding to wall cavity 7 of FIG. 2. The slot 11 is open at the top and is defined in FIG. 1 by opposing vertical side surfaces 12 and 13 sufficiently spaced which extend below the horizontal top surface 6 into the base foundation 1 and intersect a second horizontal surface 14 thereby forming a generally rectangular depression in the top horizontal surface 6. The slot 11 is continuous in that it has no beginning or end as viewed in plan. Since the base foundation 1 generally defines the perimeter of the thermal efficient building, it is necessary for the slot 11 to generally trace the perimeter and be located in association with the wall cavity 7 defined by the exterior and interior walls 8 and 9, respectively, such that any insulation material 10 inserted therebetween will necessarily enter and communicate directly with the surfaces 12, 13 and 14 defining the continuous slot 11.

Figure 3:
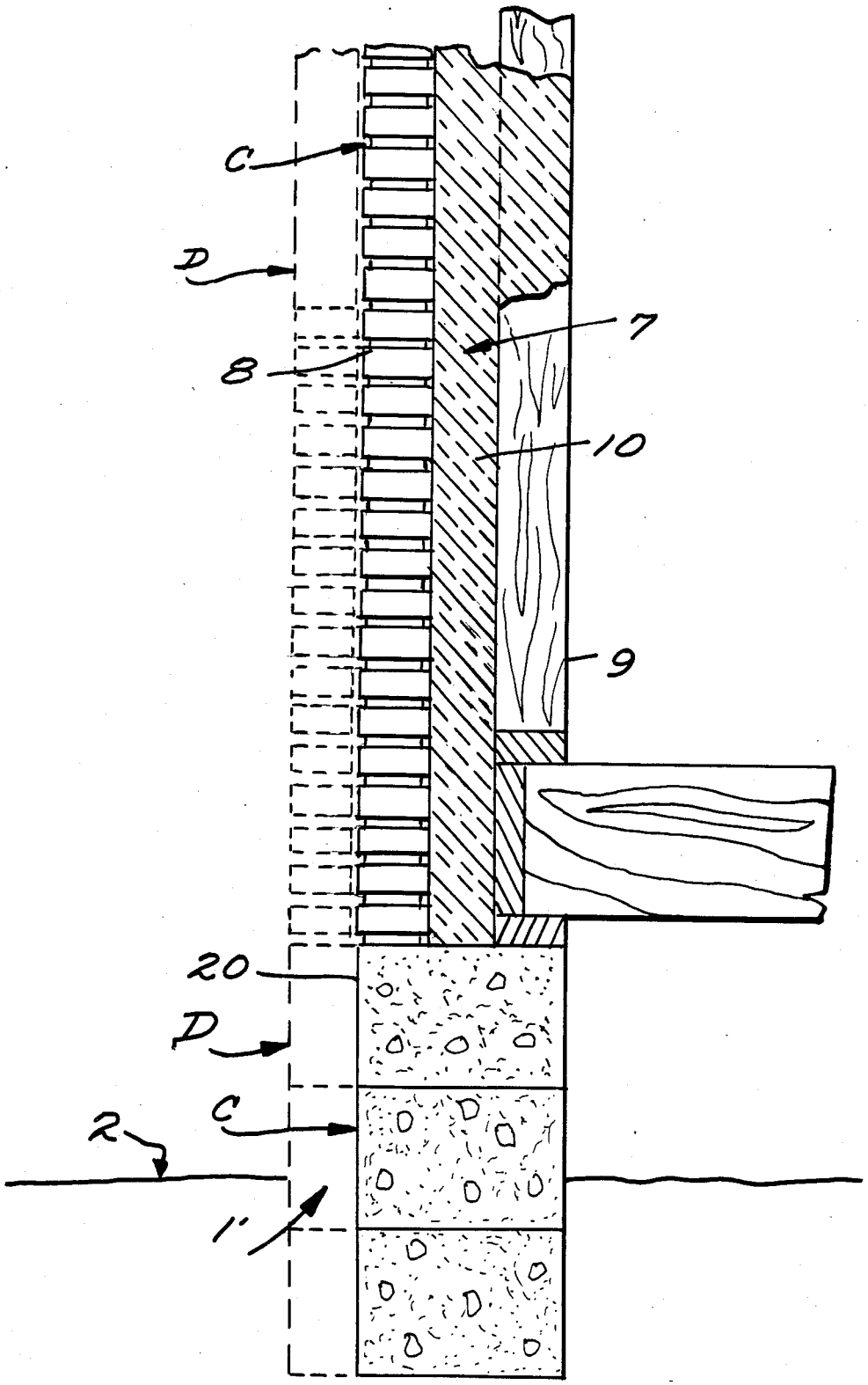
FIG. 3 is a cross-sectional view of a portion of a thermal efficient building showing another embodiment of a base foundation with the walls and floor of the building constructed thereon.

Referring now more specifically to FIG. 3, another embodiment of the present invention can be seen whereby pre-formed concrete blocks 20 of conventional dimensions are utilized to provide the base foundation 1. Once again, the contractor which constructs the thermal efficient building must take into account the factors of geographical location, meteorological and climatical conditions to determine the proper depth of the wall cavity 7 defined by the exterior and interior walls 8 and 9, respectively. If, for example, the building is to be constructed in a warm climate, the narrow horizontal dimension of the pre-formed concrete block 20 can be utilized to determine the cross-sectional dimension of the base foundation 1 thereby providing for a small wall cavity 7 into which insulating material 10 can be inserted. The position of the concrete blocks 20 utilized in constructing a thermal efficient building in a warm climate is depicted in FIG. 3 as Position C. If, for example, the building is to be constructed in a generally colder climate, the larger horizontal dimension of the pre-formed concrete block 20 can be utilized such that the cross-sectional dimension of the base foundation 1 is increased, thereby increasing the wall cavity 7 into which insulating material 10 can be inserted. The position of the concrete blocks 20 utilized in constructing a thermal efficient building in a generally colder climate is depicted in FIG. 3 as Position D.

It should be understood that this embodiment only pertains to pre-formed concrete blocks 20 of the type which have a generally rectangular shape such that one of the vertical faces of such a block 20 is necessarily larger than the perpendicularly corresponding face. Conventional pre-formed concrete blocks 20 having a generally rectangular shape with face dimensions of 16″×12″ can satisfactorily be utilized according to the present invention. However, if necessary, preformed concrete blocks 20 of varying dimensions can also be utilized depending upon the geographical factors discussed above.

Figure 4:
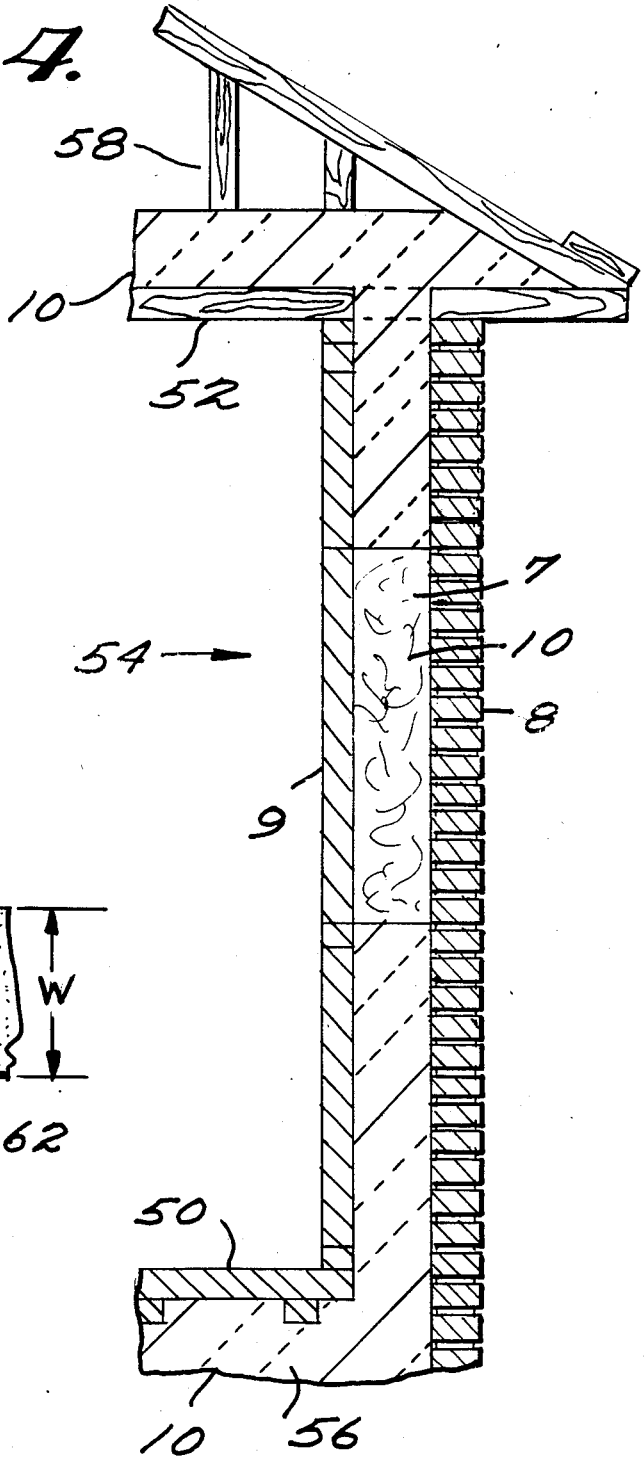
FIG. 4 is a cross-sectional view of a portion of a thermal efficient building showing a third embodiment with connections between the wall cavity, the ceiling cavity and the floor cavity so as to create an insulating envelope.

Referring now more specifically to FIG. 4, a third embodiment of the present invention can be seen showing continuity between wall cavity 7, a ceiling cavity 58 and a floor cavity 56. Floor cavity 56, disposed just beneath a finished floor 50, is filled with insulating material 10. Ceiling cavity 58, disposed just above finished ceiling 52, is similarly filled with insulating material 10. Wall cavity 7 communicates with both floor cavity 56 and ceiling cavity 58. Living space 54 is thus thermally isolated on all sides by a continuous envelope of insulating material 10 to protect the living space from the ambient temperature conditions.

Figure 5:
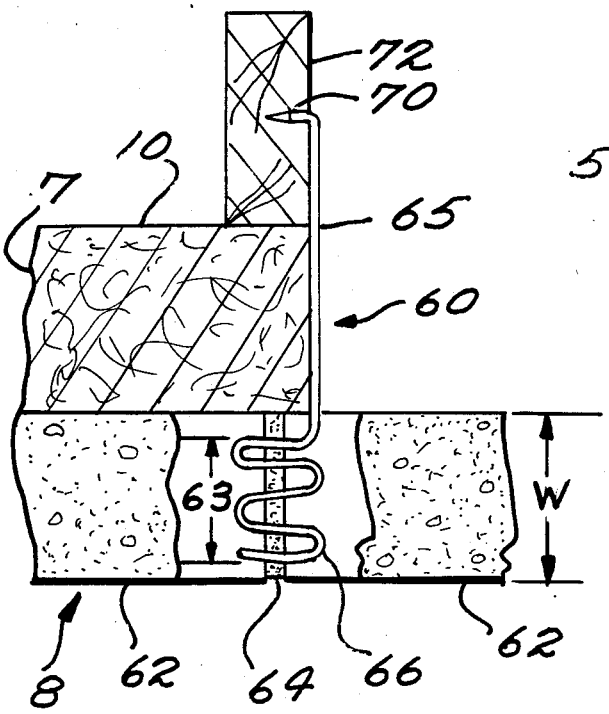
FIG. 5 is a cross-sectional plan view particularly showing the wall embodiment of FIG. 4 and including a mortar anchor.

Referring now more specifically to FIG. 5, details of the third embodiment of the present invention with an exterior masonry wall 8 is shown. Exterior wall 8 is formed of bricks 62 in a manner known to those in this art. A quantity of mortar 64 is conventionally applied between bricks 62 to securely bond the bricks one to another.

Since the wall cavity 7 of the construction technique in accordance with the present invention will not provide structural support for exterior wall 8, some means are necessary which will structurally support wall 8 and which will not significantly obstruct wall cavity 7. Such means are provided by the novel mortar anchor 60 in accordance with the present invention.

In the preferred embodiment, mortar anchor comprises a rod 65 made of steel or some other durable, strong and malleable material. A first sinusoidal end 66 of mortar anchor 60 is bent into a substantially sinusoidal shape so as to expose a greater area of end 66 to mortar for increasing the structural retaining capabilities thereof. The overall plan dimension 63 of the first sinusoidal end 66 is preferably less than the cross-sectional width "W" of bricks 62. The first sinusoidal end 66 of mortar anchor 60 is embedded in mortar 64 between bricks 62. Mortar 64 thus fills the spaces between the sinusoidally-curved portions to firmly attach mortar anchor 60 within exterior wall 8 upon curing.

A second end 70 of mortar anchor 60 is bent into a substantial right angle to rod 65 and terminates in a sharp point so that end 70 can be secured to an interior wall stud 72. Rod 65 is dimensioned so as to span wall cavity 7 and thus, as the depth of wall cavity 7 is varied to compensate for the geographical location of the thermal efficient building of the present invention, the dimension between first end 66 second end 70 of mortar anchor 60 can be similarly preselected to enable rod 65 to exactly span the wall cavity 7. Preferably, the sinusoidal first end 66 and wall stud anchoring second end 72 lie in the same plane. Mortar anchor 60 provides horizontal support for exterior wall 8 by retaining the exterior wall 8 in a constant spaced position with respect to interior wall stud 72.

Although a substantial sinusoidal shape of the first end 66 is presently preferred, other shapes could also be advantageously utilized. For example, a "square wave" shape or an alternating adjacent "V" shape could be utilized. Similarly, second end 70 need not be bent at a right angle with respect to rod 65, but could be angularly oriented in virtually limitless different manners so as to accomodate special applications.

While the invention has been herein shown and described in what is presently conceived to be the most practical and preferred embodiments thereof, it will be apparent to those of ordinary skill in the art that many modifications may be made within the scope of the invention, which scope is to be accorded the broadest interpretation of the appended claims so as to encompass all equivalent structures.

What is claimed is:

1. A thermal efficient building comprising first and second parallel vertical walls opposingly disposed defining a wall cavity therebetween, said first and second walls being constructed upon a base foundation at least a portion of which is below a finished grade and which generally defines a perimeter of the building, wherein the base foundation comprises:

means for rigidly supporting at least said first wall;

means for constructing a desired cavity width dependent upon exterior ambient thermal conditions existing at the geographical location of the building so that a horizontal thickness of an insulating material inserted into said wall cavity is sufficient to protect an interior portion of the building from the exterior ambient thermal conditions;

means for obtaining an occlusive seal between the insulating material and said foundation; and mortar anchor means for supporting said second wall with said first wall across said wall cavity, said mortar anchor means including an elongated rod member including first and second ends and a substantially straight center portion connecting said first and second ends, said center portion having a length substantially equal to said cavity width, and further including means at said first end for defining a bent portion embedded in said second wall and attaching means at said second end embedded in said first wall, said bent portion, attaching means and center portion all being horizontally coplanar to each other and also being perpendicular to said first and second walls.

2. A building as recited in claim 1 wherein the means for supporting said first wall is a poured concrete foundation.

3. A building as recited in claim 1 wherein the means for supporting the first wall includes a plurality of contiguously assembled concrete blocks each having a first cross-sectional dimension spanning said cavity less than a second cross-section dimension different from said first cross-sectional dimension.

4. A building as recited in claim 2 wherein said means for constructing the desired cavity width comprises an upper portion of the exterior surface of the base foundation outwardly inclined such that the width of said foundation measured at an horizontal top surface upon which the first and second walls are constructed is greater than the width of said foundation measured at a lower portion.

5. A building as recited in claim 4 wherein the inclined upper portion of the exterior surface starts at a line formed by the intersection of the horizontal plane of the finished grade and the vertical plane of the lower portion of said foundation.

6. A building as recited in claim 5 wherein the width measured at the horizontal surface of the base foundation upon which the first and second walls are constructed is 16 inches.

7. A building as recited in claim 3 wherein said first and second cross-sectional dimensions of each concrete block are 12 inches and 16 inches respectively.

8. A building as recited in claim 1 wherein the means for obtaining an occlusive seal is a continuous slot embedded in a top horizontal surface of the foundation characterized by comprising opposing vertical surfaces extending below said top horizontal surface of the foundation to a sufficient depth and intersecting with a second horizontal surface of sufficient width, said slot further characterized by being extended along the entire top horizontal surface of the foundation and adapted to accepting at least a portion of the insulating material.

9. A building as recited in claim 8 wherein the depth of the opposing vertical surfaces are about 1.5 inches each, and the width of the second horizontal surface is about 3.5 inches.

10. A building as recited in claim 1 wherein said second vertical wall is a masonry wall.

11. A building as recited in claim 1 wherein said first vertical wall comprises a plurality of generally 2 inch wide by 4 inch deep wooden stud members.

12. A building as recited in claim 4 wherein the width measured at the top horizontal surface of the base foundation upon which the first and second walls are constructed is 16 inches.

13. A building as recited in claim 1 further comprising:

a horizontal ceiling connected to a top surface of said first vertical wall;

a roof connected to a top surface of said second vertical wall and defining a ceiling cavity between said ceiling and said roof, said wall cavity defined between said first and second vertical walls being in communication with said ceiling cavity whereby a quantity of additional insulating material is inserted within said ceiling cavity, said additional insulating material being in contact with said insulating material inserted in said wall cavity.

14. A building as recited in claim 1, further comprising:

a horizontal floor connected to a bottom surface of said second vertical wall;

a horizontal subfloor connected to a bottom surface of said first vertical wall and defining a floor cavity between said floor and said subfloor in communication with said wall cavity defined between said first and second walls whereby a quantity of additional insulating material is inserted within said floor cavity in contact with said insulating material inserted in said wall cavity.

15. A building as recited in claim 14, further comprising:

a horizontal ceiling connected to a top surface of said first vertical wall;

a roof connected to a top surface of said second vertical wall and defining a ceiling cavity between said ceiling and said roof, said wall cavity defined between said first and second vertical walls being in communication with said ceiling cavity whereby a quantity of additional insulating material is inserted within said ceiling cavity, said additional insulating material being in contact with said insulating material inserted in said wall cavity.

16. A mortar anchor for attaching a masonry wall to a wall stud in a building structure comprising a rod having a first deviously bent end for embedding within said masonry wall, a second end, and a substantially straight center portion connecting said first and second ends, said second end bent at a substantial right angle with respect to said center portion, said right angle bend terminating in a sharp point for attaching to said wall stud, the dimension of said center portion being predetermined by the distance between said wall stud and said masonry wall, said first and second ends and said center portion all lying in the same plane.

17. A mortar anchor as recited in claim 16 wherein said first end defines a substantially sinusoidal curve.

18. A mortar anchor as recited in claim 16 wherein an overall plan dimension of said first end is not greater than said cross-sectional width of said masonry wall.

19. A mortar anchor as recited in claim 16 wherein said first and second ends lie in the same plane.

20. A building as recited in claim 10 wherein said first end defines a substantially sinusoidal curve.

21. A building as recited in claim 10 wherein an overall plane dimension of said first end of said mortar anchor means is not greater than the cross-sectional width of said masonry wall.

22. A building as recited in claim 10 wherein said first and second ends of said mortar anchor means lie in the same plane.

23. A device for rigidly interconnecting a vertical masonry wall and a vertical interior wall of the type including spaced-apart vertical stud members, the masonry wall and interior wall being substantially parallel to one another and defining therebetween a wall cavity for accepting a quantity of insulating material therein, said device comprising an elongated rod member including at one end means defining a bent portion for being embedded in a mortar joint of said masonry wall, a substantially straight center portion connecting said one end to an opposite end, and attaching means at the opposite end for attaching said rod member to a preselected one of said stud members, said center portion having a length substantially equal to the width of the wall cavity between said masonry and interior walls, said bent portion, center portion and attaching means all lying in the same horizontal plane perpendicular to both of said masonry wall and said interior wall.

* * * * *